United States Patent [19]

Robinson et al.

[11] 4,184,841

[45] Jan. 22, 1980

[54] KILN FURNITURE, PARTICULARLY CRANK STRUCTURES

[75] Inventors: William G. Robinson, Newcastle; Horace G. Fellows, Tettenhall, both of England

[73] Assignee: Allied Insulators, Limited, Stoke-on-Trent, England

[21] Appl. No.: 882,423

[22] Filed: Mar. 1, 1978

[51] Int. Cl.[2] ..... F27D 5/00

[52] U.S. Cl. ..... 432/258; 432/259

[58] Field of Search ..... 432/253, 258, 259

[56] References Cited

U.S. PATENT DOCUMENTS 1,739,037 12/1929 Louthan ..... 432/259

3,057,035 10/1962 Layne ..... 432/259

FOREIGN PATENT DOCUMENTS 520614 4/1940 United Kingdom ..... 432/259

1047808 11/1966 United Kingdom ..... 432/259

*Primary Examiner*—John J. Camby

*Attorney, Agent, or Firm*—Neil F. Markva

[57] ABSTRACT

A crank for holding and supporting articles of refractory or ceramic flatware in spaced and stacked relationship during kiln firing has upper and lower end units rigidly interconnected by a first set of vertical spacing pillars which are each bonded at their ends to the respective end units thereby to form a rigid unitary frame structure. Support means are provided for holding and supporting the articles of refractory or ceramic flatware in spaced and stacked relationship within the rigid unitary frame structure. The support means comprise a second set of separate detachably mounted additional support posts which each have a plurality of spaced-apart sockets into which fit or plug laterally projecting pins or pegs to form a removable rack adapted to support the flatware articles.

9 Claims, 6 Drawing Figures

32'
10'a
41
40
42
25'
11a
30
31

KILN FURNITURE, PARTICULARLY CRANK STRUCTURES

The present invention relates to kiln furniture and has particular reference to devices, traditionally termed "cranks", for holding and supporting articles of refractory or ceramic flatware in spaced and stacked relationships during kiln firing.

Such cranks conventionally comprise a set of three triangularly spaced upstanding pillars or posts maintained between upper and lower end units, forming a cover and base respectively, having sockets into which fit or plug the respective end portions of the pillars or posts to form a frame structure. Along their length said pillars or posts have a series of aligned holes, disposed at spaced intervals in mutual horizontal planes, into which are fitted laterally projecting replaceable pins or pegs directed generally towards a central axis to form a rack adapted to support articles of refractory or ceramic flatware inserted or stacked therein by engagement of said pins or pegs with peripheral portions of said flatware articles.

The cover, base and pillars have generally been made as individual pieces and it has been the common practice for them to be held together by gravity and the weight of flatware supported by the assembled crank. One reason for this method of assembly has been to enable the crank to be dismantled after the flatware content has been fired in a kiln so that the pins or pegs can then be replaced by new ones, an operation which is usually carried out in a machine and which is generally necessary due to contamination of the pins or pegs by the flatware during firing.

One disadvantage of such arrangements in which the end plates and pillar or post components are all detachably interconnected is that the frame structure so formed tends to lack rigidity and cranks cannot be stacked one crank vertically supporting another without the possibility of the structure and the flatware contained therein becoming unstable and collapsing. Lack of rigidity also limits the practical height to which a single crank assembly can be made.

SUMMARY OF THE INVENTION

According to the present invention, a crank for holding and supporting articles of refractory or ceramic flatware in spaced and stacked relationship during kiln firing has a first set of spaced-apart upstanding frame pillars or posts extending between and interconnecting an upper end unit and a lower end unit forming a cover and a base respectively. The frame pillars or posts are each bonded and fixed at their ends to the respective said end units to form a rigid unitary frame structure. Further support means hold and support the articles of refractory or ceramic flatware in spaced and stacked relationship. The further support means comprises a second set of separate detachably mounted spaced-apart support pillars or posts which each have a series of spaced sockets into which plug or fit laterally projecting pins or pegs to form collectively a rack for supporting the flatware articles by direct engagement with peripheral portions thereof.

Also according to the invention, a crank, for holding and supporting articles of refractory or ceramic flatware in spaced and stacked relationship during kiln firing, comprises a rigid unitary frame structure composed of an upper end unit forming a cover, a lower end unit forming a base in vertically spaced relationship below said upper end unit, together with a set of at least said upper end unit. A set of at least three spaced-apart frame pillars or posts extend vertically between and interconnect the upper and lower end units to which they are each bonded and fixed at their ends. A set of separate spaced-apart support pillars or posts are detachably mounted in the frame structure and each has a series of spaced sockets into which plug or fit laterally projecting pins or pegs. The pillars and pegs form collectively a rack for holding and supporting the flatware articles at different levels in spaced and stacked relationship by direct engagement with peripheral portions of said flatware articles.

The end units may be adapted to receive the ends of these support pillars or posts in loose fitting engagement within locating sockets or recesses which permit each support pillar or post, complete with its pegs or pins, to be removed from and replaced in the frame structure of the crank by a sequence of predetermined manipulatory movements. Conveniently, each such removable support pillar or post is mounted closely adjacent and in parallel relationship with one of the fixed frame pillars or posts.

The fixed frame pillars or posts are each preferably bonded at their ends to the respective end units by cement or ceramic jointing. The surfaces of these frame pillars or posts may advantageously be roughened or otherwise shaped e.g. ridged at their ends to key into and provide a grip for such cement or jointing.

The end units may also advantageously be formed of such a shape, such as an open V-shaped configuration, as will enable a plurality of identical cranks to be fitted together in compact nested relationship for transport and storage.

BRIEF DESCRIPTION OF DRAWINGS

By way of example, the invention will now be more particularly described with reference to the accompanying drawings in which.

DETAILED DESCRIPTION

Figure 1:
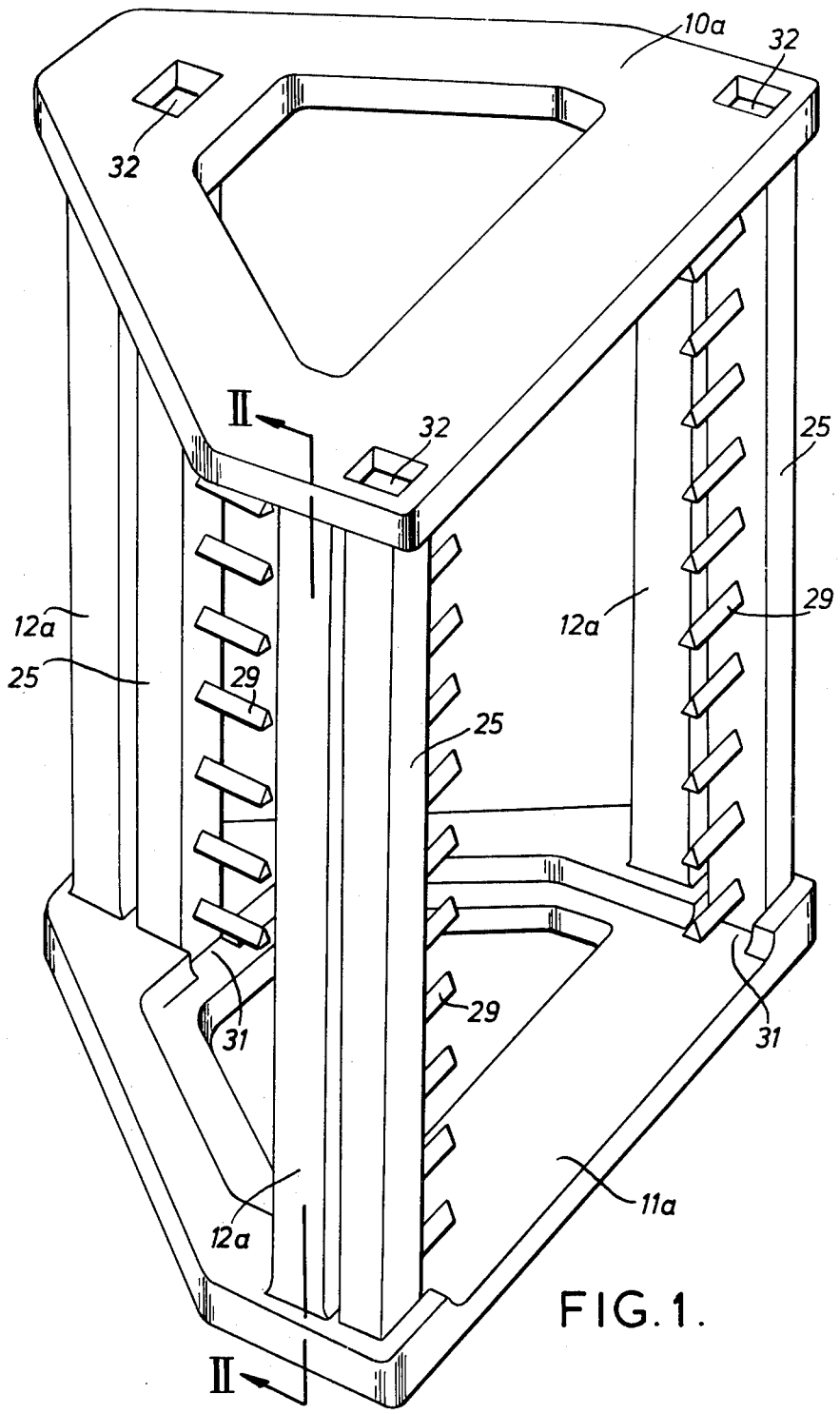
FIG. 1 is a perspective view of a crank according to one preferred embodiment of the invention.
Figure 2:
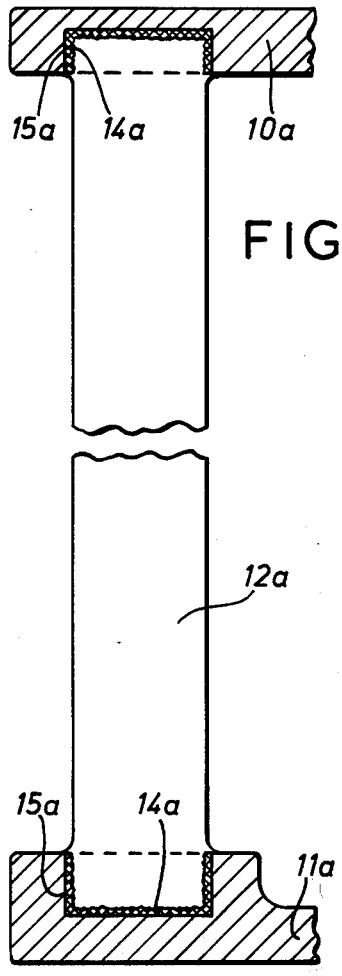
FIG. 2 is a sectional view on line II—II of FIG. 1.
Figure 3:
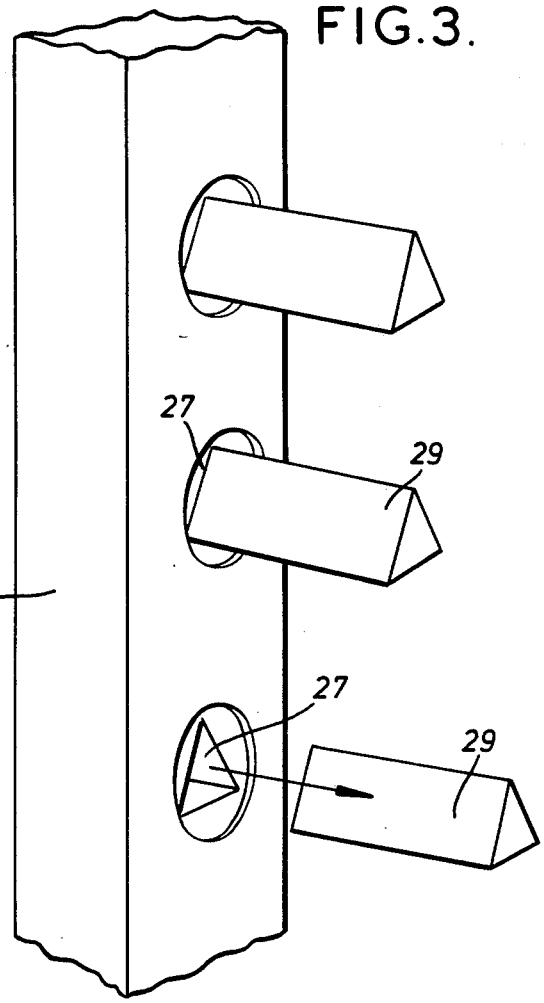
FIG. 3 is a detail view showing the fitting of removable pegs or pins in supporting pillars or posts of the structure of FIG. 1.

In the embodiment of FIGS. 1 and 2, the crank is in the form of a rigid unitary frame structure made up from substantially triangular plate-like upper and lower end units, 10*a* and 11*a*, interconnected by three vertical frame pillars or posts 12*a* adjacent the corners.

The components are all composed of refractory material and the ends of pillars or posts 12*a* are each fitted into complementary sockets 15*a* in the end units wherein they are bonded and permanently fixed in place such as by a cement or ceramic jointing 14*a* in FIG. 2. Also, to improve the grip of and to "key-in" the bonding material, the surfaces of at least the ends of the pillars or posts are advantageously roughened, but in alternative modifications there may be a special profiling of the surfaces to give a keying effect. In this illustrated example, the ends of the pillars or posts 12*a* have ends of slightly reduced cross-section fitting into blind sockets while shoulders abut and locate against the faces of end units 10*a* and 11*a*. The the precise form of the sockets and of the ends of the pillars or posts may be varied somewhat, as desired.

Pillars or posts 12*a* have plain faces without projections and serve only as frame members rigidly interconnecting end units 10*a* and 11*a*. Three separate vertical support pillars or posts 25 are detachably mounted between end units 10*a* and 11*a*. Each post 25 is closely adjacent and in parallel relationship with each one of the fixed frame pillars 12*a* and supports the flatware articles. As shown, each support pillar or post 25 has a series of spaced sockets 27 into which laterally projecting, triangular section pins or pegs 29 plug and fit in a conventional manner to form collectively a rack for supporting the flatware articles by direct contact with peripheral portions thereof.

Support pillars or posts 25 are detachably mounted so that after a kiln firing, they can be readily removed to facilitate the replacement of pins or pegs 29 which is usually necessary and which is customarily carried out by a machine in a single operation on each pillar or post.

Figure 4C:
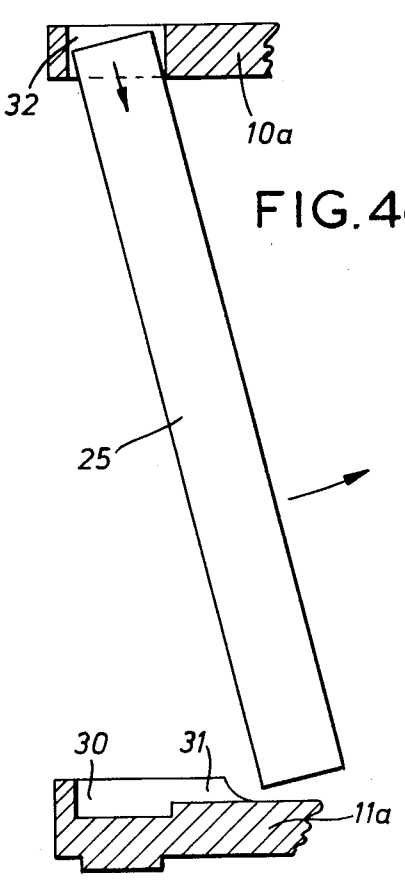
FIGS. 4*a*, 4*b* and 4*c* are diagrams showing the manner of fitting and removal of the supporting pillars or posts in the structure of FIG. 1.
Figure 4B:
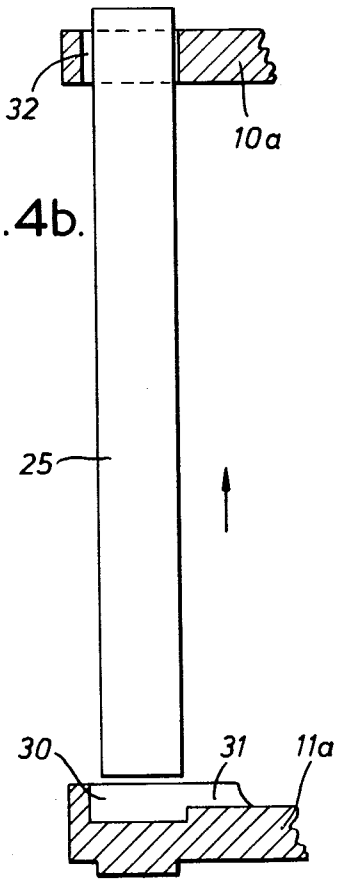
Figure 4A:
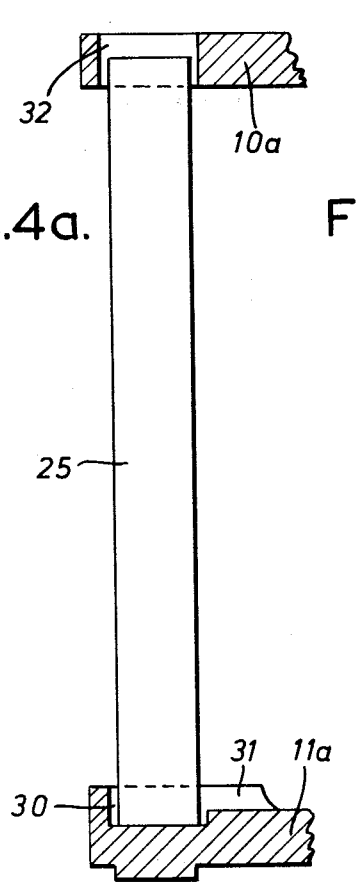

The lower ends of support pillars or posts 25 are in loose fitting engagement with shallow sockets 30 in lower end unit 11*a*. Thus, the lower ends of pillars or posts 25 are inserted therein by a lateral movement through a relatively deep gap 31 at one side. The upper end unit 10*a* includes openings 32 which are sufficiently large to accommodate the upper ends of support pillars or posts 25 to permit the angular movement necessary in positioning the lower ends in sockets 30. The full sequence of operations in removing a pillar or post 25 is shown in FIGS. 4*a* to 4*c* and involves a small vertical lifting movement followed by a sideways angular movement. The replacement is carried out in the reverse sequence.

Figures 5A, 5B, 5C, 5D:
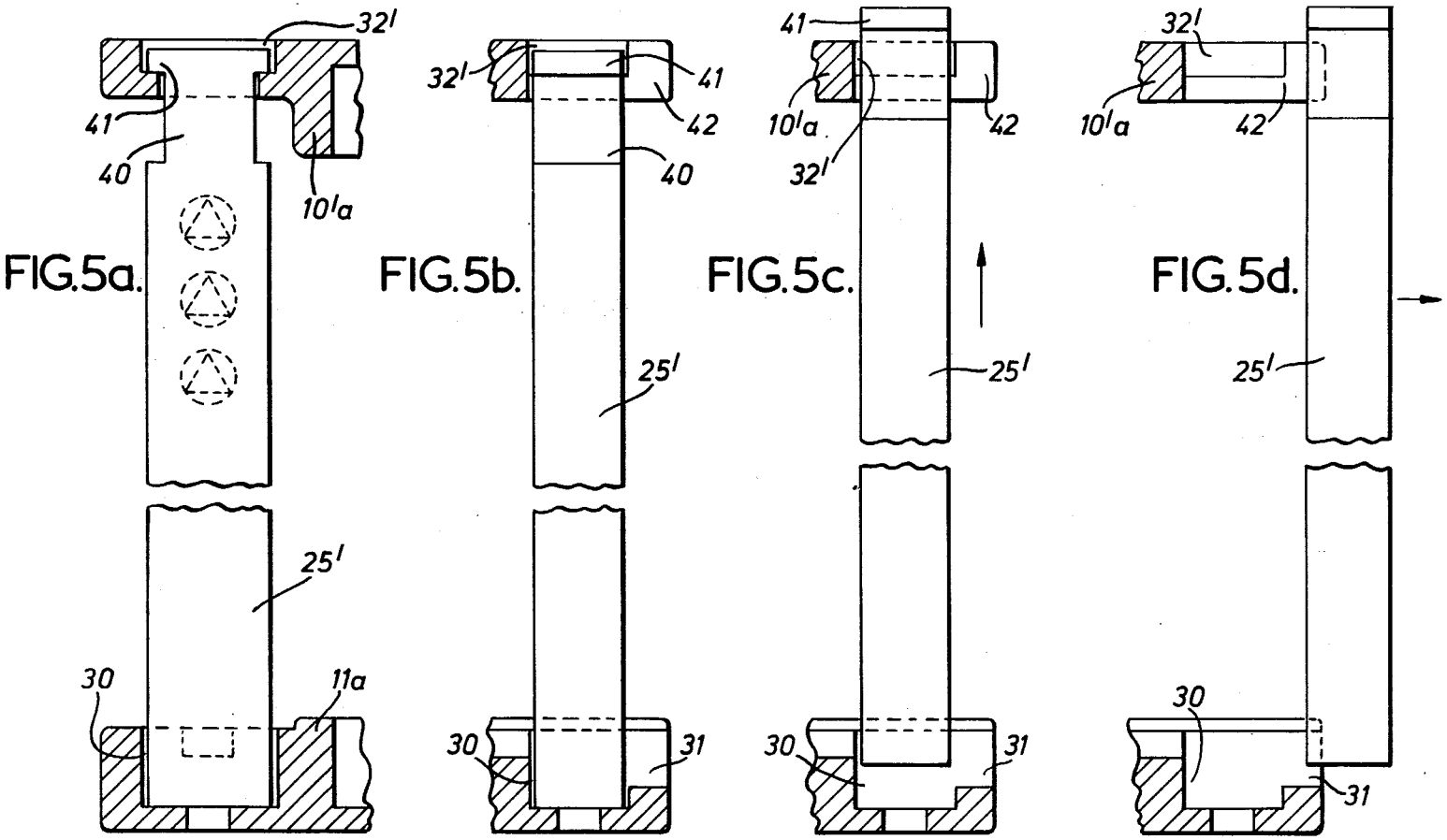
FIGS. 5*a*, 5*b*, 5*c* and 5*d* are diagrams showing an alternative manner of fitting and removal of the supporting pillars or posts in a modification of the structure of FIG. 1.

In the modification shown in FIGS. 5*a* to 5*d*, support pillars or posts 25' each have a neck portion 40 of reduced width terminating at their upper end in a head portion 41. Openings 32' in upper end unit 10'*a* are of counterbore form with a narrower lower section having a width which is only slightly greater than that of neck portion 40. Slot 42 opens out through to the periphery of end unit 10'*a* at one side thereof and has a width only slightly greater than neck portion 40. With this arrangement, as illustrated in the sequence of FIGS. 5*b*, 5*c* and 5*d*, each support pillar or post 25' can be removed by first lifting to bring head portion 41 above the top of upper end unit 10'*a*.

Pillar or post 25' is then moved sideways to pass neck portion 40 through slot 42. No angular movement is needed in this operation. Again, replacement is a reverse sequence of movement.

In both the above arrangements, no additional securing or fastening devices are needed. The support pillars or posts are fitted and removed solely by manipulatory movements which facilitates easy handling under operational conditions.

Figure 6:
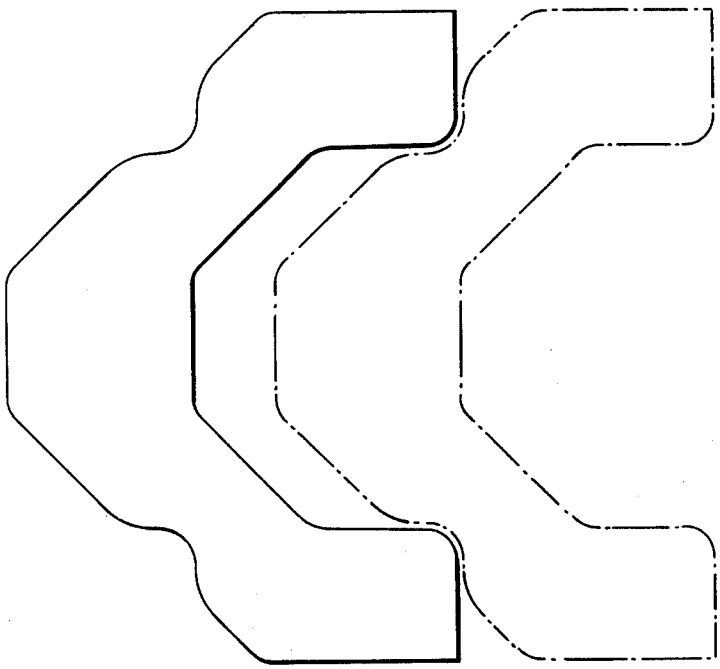
FIG. 6 shows a modified shape for the end units of the structures of the cranks in accordance with the invention which permits fitting together in compact nested relationship.

A further useful modification, which can be applied to each of the embodiments hereinbefore described, consists in shaping the end units so as to permit fitting together of a plurality of identical cranks in compact nested relationship. FIG. 6 shows in full lines one example of a modified shape for each of the upper and lower end units which has an open V-shaped or re-entrant configuration to enable this result to be achieved as demonstrated by the illustration in broken lines of another end unit of identical shape placed adjacent thereto. Since the frame structures of the cranks are of rigid unitary form, this feature is important and useful for reducing the total bulk volume required when transporting and storing a number of the cranks together.

We claim:

1. A crank for holding and supporting articles of refractory or ceramic flatware in spaced and stacked relationship during kiln firing, said crank comprising:

(a) upper and lower end units, (b) a first set of frame pillars having each end thereof fixedly attached to a respective upper and lower end unit to form a rigid unitary frame structure, (c) a second set of separate support posts having each end thereof detachably mounted to a respective upper and lower end unit, (d) each said separate support post having a plurality of spaced apart sockets, and (e) support pins which plug into said sockets and project laterally to form collectively with said support posts a replaceable supporting rack.

2. A crank as defined in claim 1 wherein said upper and lower end units each include a plurality of spaced sockets, said support posts each have upper and lower end portions which engage and fit loosely within said sockets of the end units to permit each support post complete with its laterally projecting support pegs to be removed from and replaced in the rigid unitary frame structure of the crank.

3. A crank as defined in claim 2 wherein each socket of the upper end unit has a width greater than the corresponding cross-sectional dimensions of the upper end portion of the support posts whereby the upper end portion of each support post can be introduced obliquely into the respective socket of the upper end unit before the lower end portion is brought into alignment with and engaged in the respective socket of the lower end unit when being fitted in place.

4. A crank as defined in claim 2 wherein the upper end portion of each support post has a neck portion of reduced width and a head portion surmounting said neck portion, each socket of the upper end unit includes a gap at one side sufficient to permit passage laterally of said reduced neck portion of the upper end portion of the associated detachable support post, each upper socket further has a lower bore portion of a width commensurate with the dimensions of said neck portion of the detachable support post and an upper counter-bore portion of larger width commensurate with the dimensions of said head portion of the detachable support post, whereby each support post can be removed by first lifting vertically and then moved sideways to pass the neck portion through said gap and can be replaced by a reverse sequence of movements.

5. A crank as defined in claim 2 wherein the upper and lower end units each comprises a substantially triangular plate composed of refractory material, and there are three frame pillars in said first set and three support posts in said second set, said pillars and posts being triangularly disposed adjacent the corners of the upper and lower end units with each support post mounted in parallel relationship with and proximate to a respective fixed frame pillar.

6. A crank as defined in claim 5 wherein the upper and lower end units each have an open V-shaped configuration which permits a plurality of identical such cranks to nest compactly together for transport and storage.

7. A crank as defined in claim 1 wherein the frame pillars are fixedly attached with a bonding material.

8. A crank as defined in claim 7 wherein the bonding material is cement or ceramic jointing material.

9. A crank as defined in claim 1 wherein two of the support posts are spaced apart by a distance sufficient to permit flatware to be introduced by a lateral displacement movement into the unitary frame structure while the flatware is in a horizontal orientation.

* * * * *